US012723776B2

(12) United States Patent
TenEycke

(10) Patent No.: US 12,723,776 B2
(45) Date of Patent: Sep. 1, 2026

(54) STEPPED SEGMENTAL BAFFLE FOR ELECTRIC PROCESS HEATER

(71) Applicant: Thermon Canada Inc., Edmonton (CA)

(72) Inventor: David TenEycke, Oakville (CA)

( * ) Notice: Subject to any disclaimer, the term of this patent is extended or adjusted under 35 U.S.C. 154(b) by 165 days.

(21) Appl. No.: 18/357,719

(22) Filed: Jul. 24, 2023

(65) Prior Publication Data

US 2025/0035384 A1 Jan. 30, 2025

(51) Int. Cl.

| | |
|---|---|
| ***F24H 9/00*** | (2022.01) |
| ***F24H 1/10*** | (2022.01) |
| ***F24H 9/20*** | (2022.01) |
| *F28F 9/22* | (2006.01) |

(52) U.S. Cl.

CPC ..... *F24H 1/102* (2013.01); *F24H 9/0021* (2013.01); *F24H 9/2028* (2013.01); *F28F 9/22* (2013.01)

(58) Field of Classification Search

CPC ..... F24H 1/102; F24H 9/2028; F24H 9/0021; F28F 9/22

See application file for complete search history.

(56) References Cited

U.S. PATENT DOCUMENTS

| | | | | |
|---|---|---|---|---|
| 3,400,758 A * | 9/1968 | Man | F28F 9/22 159/901 |
| 3,446,939 A * | 5/1969 | Morgan | F24H 1/202 392/452 |
| 2022/0236014 A1* | 7/2022 | Streiff | F28D 7/1615 |

FOREIGN PATENT DOCUMENTS

| | | | |
|---|---|---|---|
| CN | 203933993 U * | 11/2014 | |
| CN | 205784743 U * | 12/2016 | |
| DE | 2410292 A * | 9/1975 | F28F 9/22 |
| DE | 102011015215 A1 * | 9/2012 | F24H 1/102 |
| JP | 2014214896 A * | 11/2014 | F28D 7/16 |
| KR | 20170116704 A * | 10/2017 | F24H 9/02 |
| SU | 771909 A1 * | 10/1980 | |

* cited by examiner

*Primary Examiner* — Eric S Ruppert

(57) ABSTRACT

Disclosed herein is a novel stepped segmental baffle for an electric process heater. This baffle includes a plurality of stepped segments, wherein each of the stepped segments is a flat structure having a plurality of perforations through which elongated heating elements extend. The stepped segments are disposed orthogonally relative to the central axis and the stepped segments are spaced apart from each other by an axial distance. This baffle is easier to manufacture as a stepped segmental baffle than prior-art helical or spiral baffles. The stepped segmental baffle provides better performance of the electric process heater by increasing the heat transfer rate by forcing fluid flow over the heating elements. An electric process heater incorporating the stepped segmental baffles provides improved performance for the same heater size or provides the same performance in a smaller and more compact heater as compared to the prior art.

6 Claims, 16 Drawing Sheets

STEPPED SEGMENTAL BAFFLE FOR ELECTRIC PROCESS HEATER

TECHNICAL FIELD

The present invention relates generally to electric process heaters and more particularly to baffles of electric process heaters.

BACKGROUND

Electric process heaters have been used for many years in various industries. The design of many process heaters typically involves the use of tubular metal-sheathed heating elements formed into a hairpin shape in which one or more heating elements are arranged in a heating bundle and placed inside a fluid-containment piping system. Although many such designs are known in the art, there remains a need in the industry to improve the effective heat transfer rate of heat produced by the electric heater to the fluid being heated. It is also known to use baffles in electric process heaters to improve heat transfer efficiency. Spiral baffles or helical baffles are used in some applications but the shape of these baffles makes these difficult to manufacture. An example of helical baffles is disclosed in US Patent Application Publication 2019/0063853, which is hereby incorporated by reference.

An improved baffle design for an electric process heater is thus highly desirable.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

The present specification discloses a novel baffle for an electric process heater having a central axis. The baffle is a stepped segmental baffle. The baffle includes a plurality of stepped segments. Each of the stepped segments is a flat structure having a plurality of perforations through which elongated heating elements extend. The stepped segments are disposed orthogonally relative to the central axis and the stepped segments are spaced apart from each other by an axial distance.

The present specification also discloses an electric process heater that includes a vessel containing a fluid and a plurality of elongated heating elements extending inside the vessel parallel to a central axis of the electric process heater. The electric process heater further includes a plurality of stepped segmental baffles disposed at axial intervals inside the electric process heater to promote heat transfer between the elongated heating elements and the fluid inside the vessel. Each of the plurality of stepped segmental baffles has a plurality of segments defined by a flat structure that includes a plurality of perforations through which the elongated heating elements extend. The stepped segments are disposed orthogonally relative to the central axis and the stepped segments are spaced apart from each other by an axial distance.

BRIEF DESCRIPTION OF THE DRAWINGS

These and other features of the disclosure will become more apparent from the description in which reference is made to the following appended drawings.

DETAILED DESCRIPTION OF EMBODIMENTS

Figure 1:
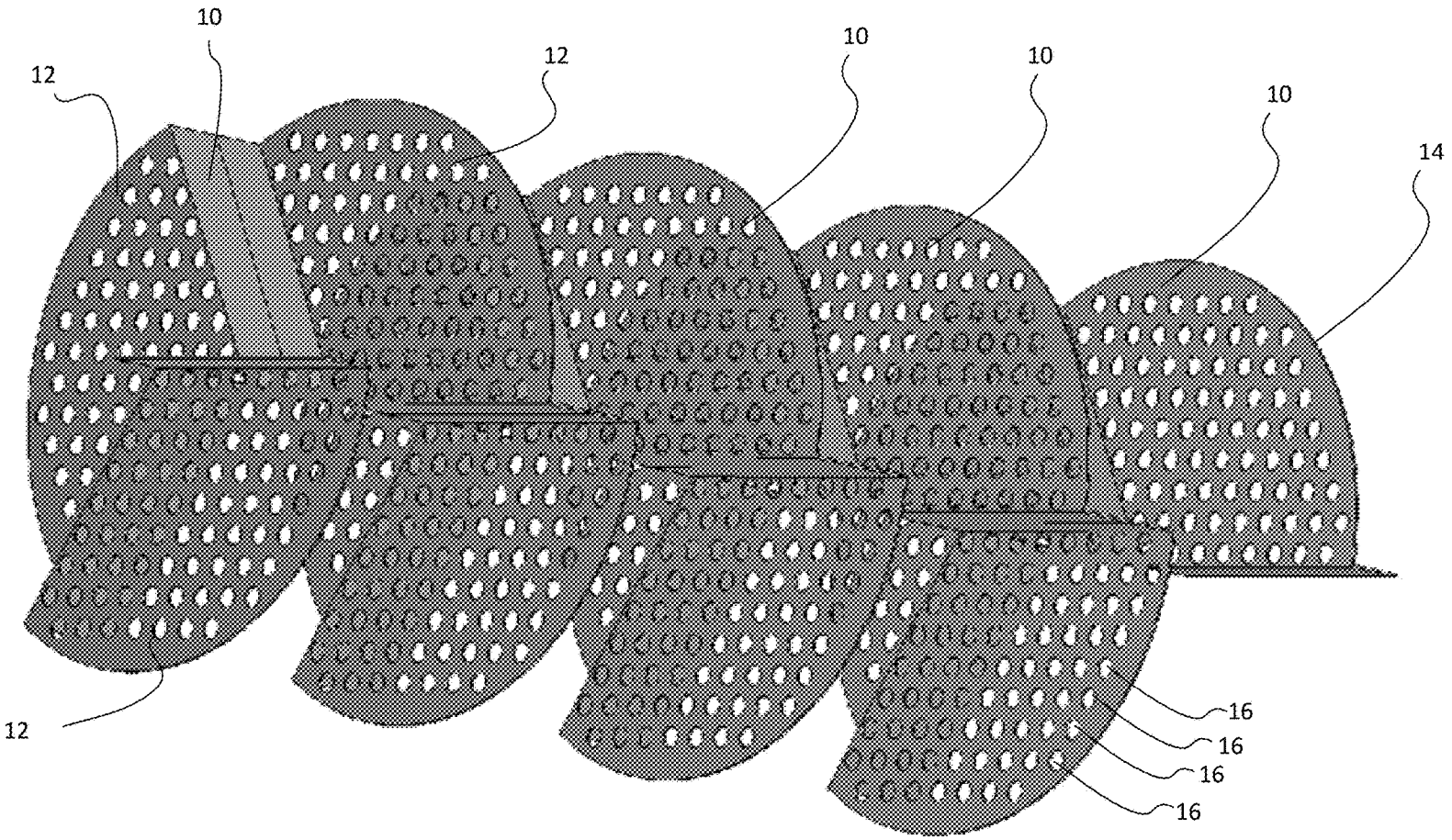
FIG. 1 is a perspective view of a stepped segmented baffle in accordance with an embodiment of the present invention.
Figure 2:
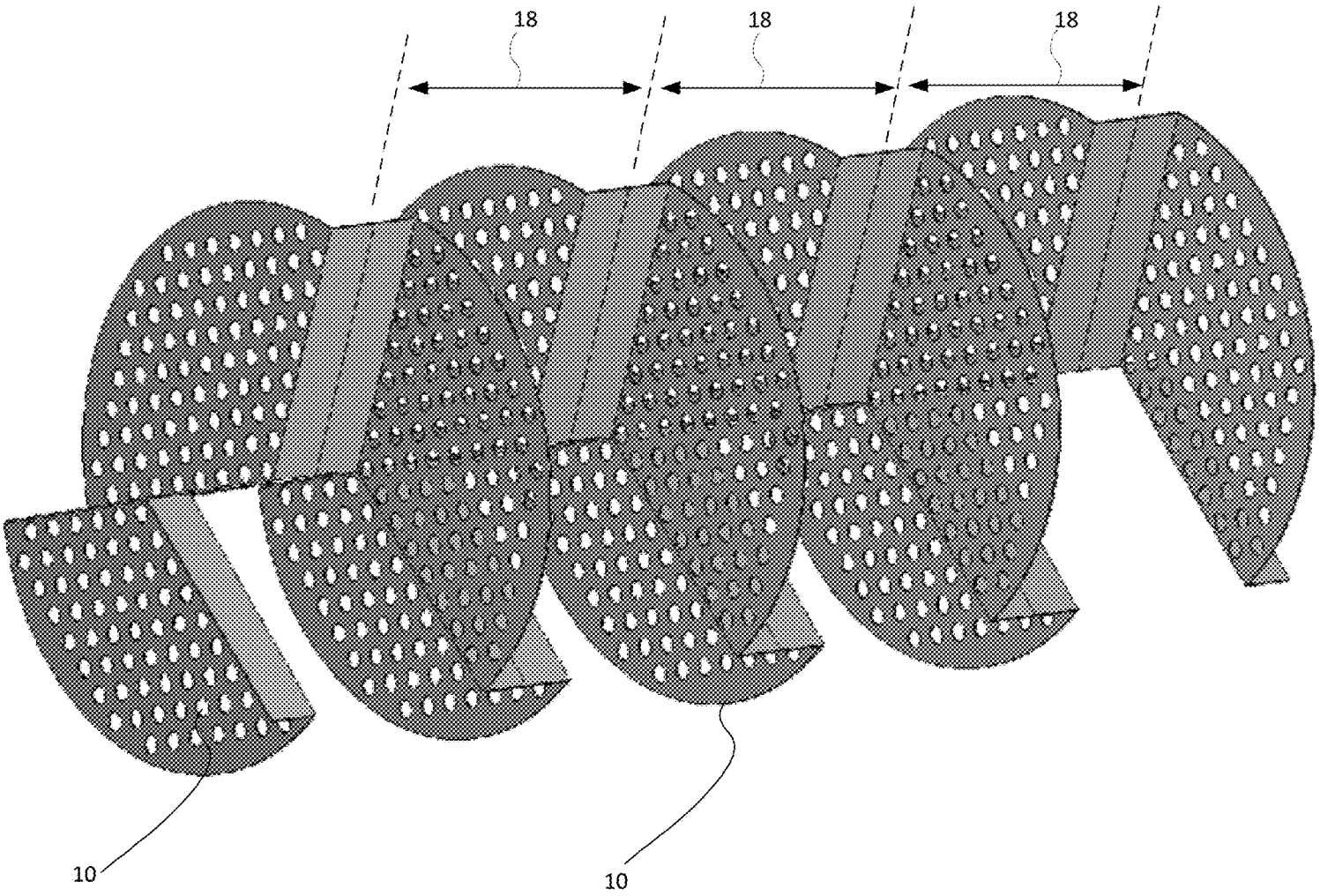
FIG. 2 is another perspective view of the stepped segmented baffle.
Figure 3:
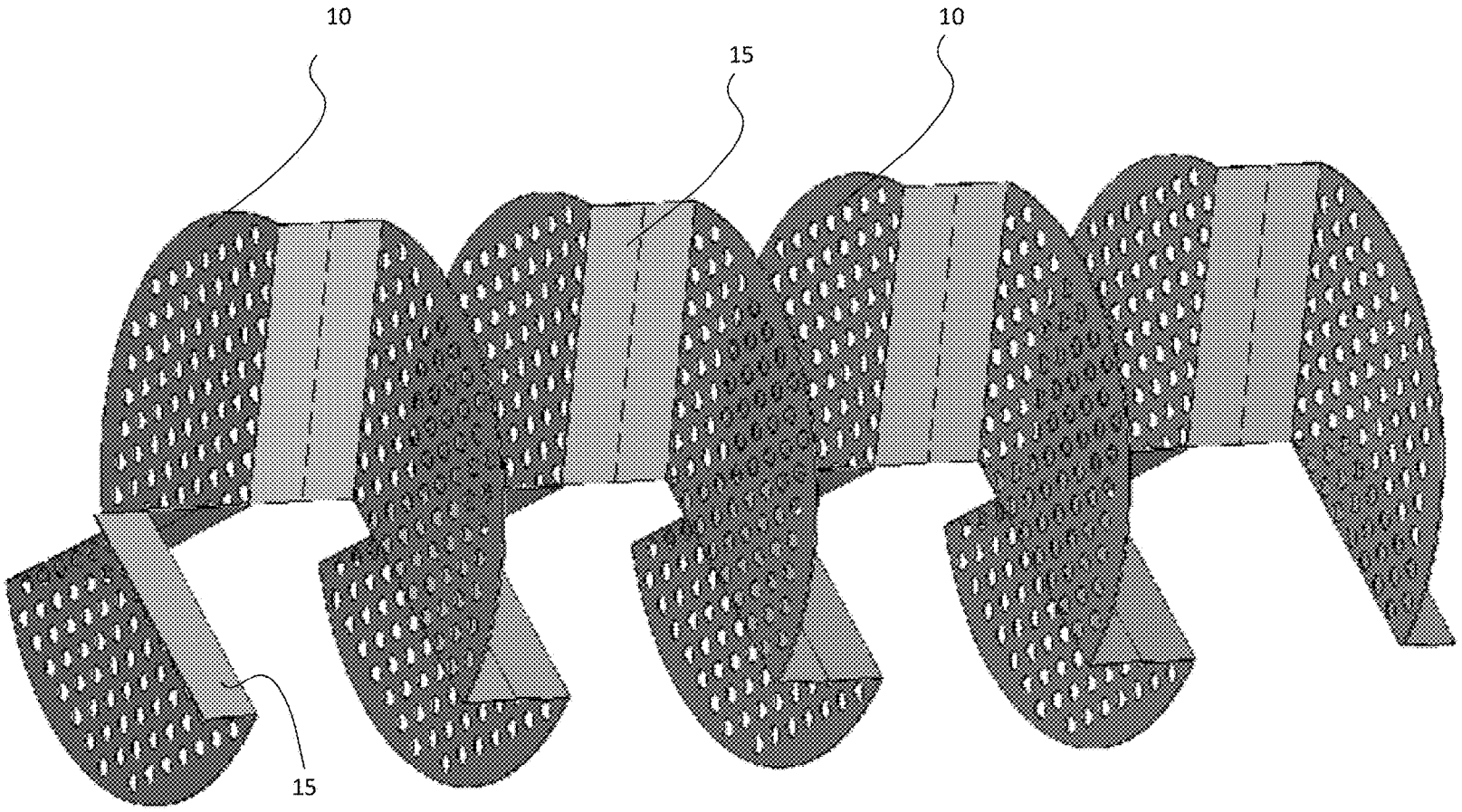
FIG. 3 is another perspective view of the stepped segmented baffle.
Figure 4:
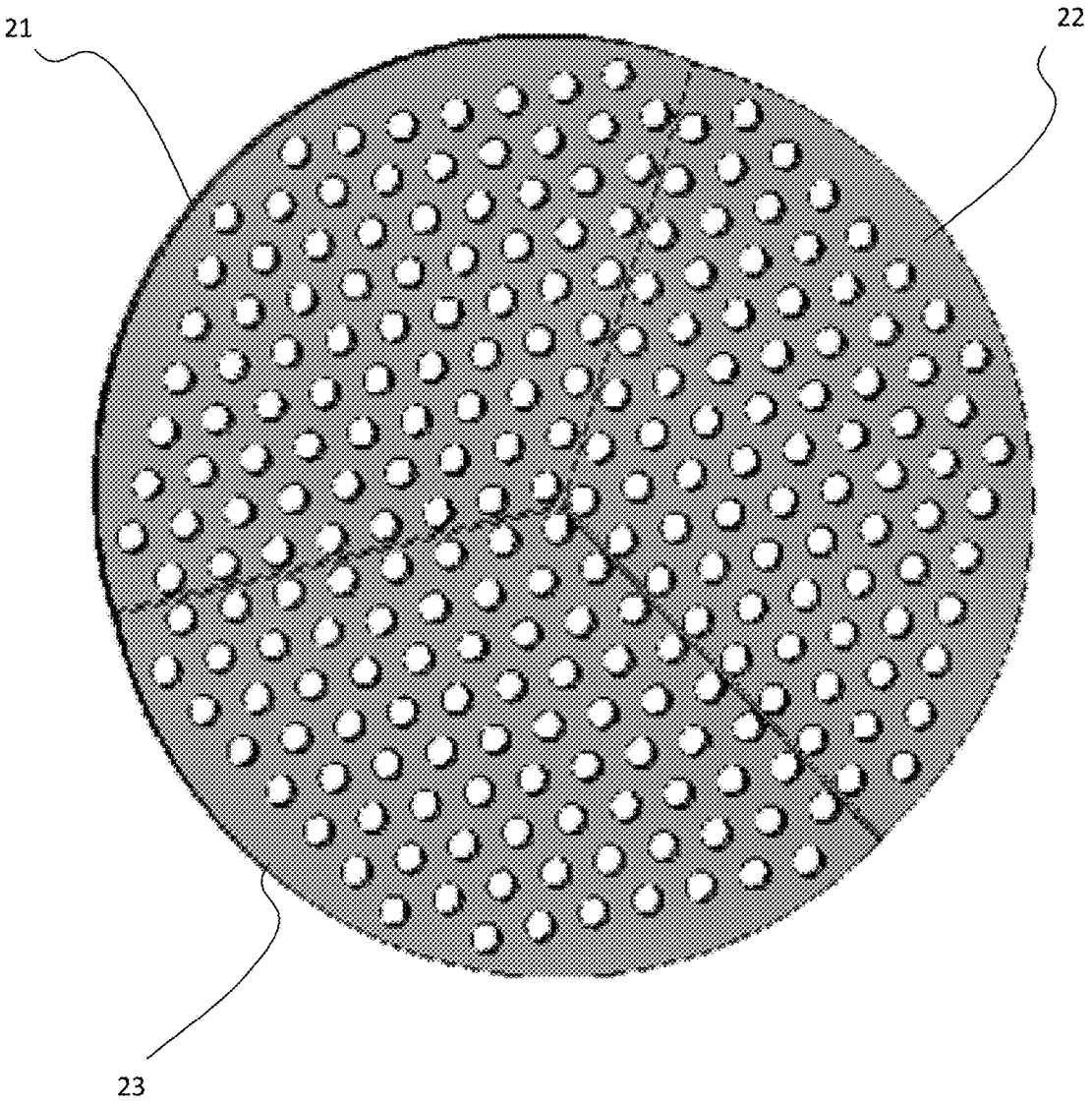
FIG. 4 is an end view of the stepped segmented baffle.
Figure 5:
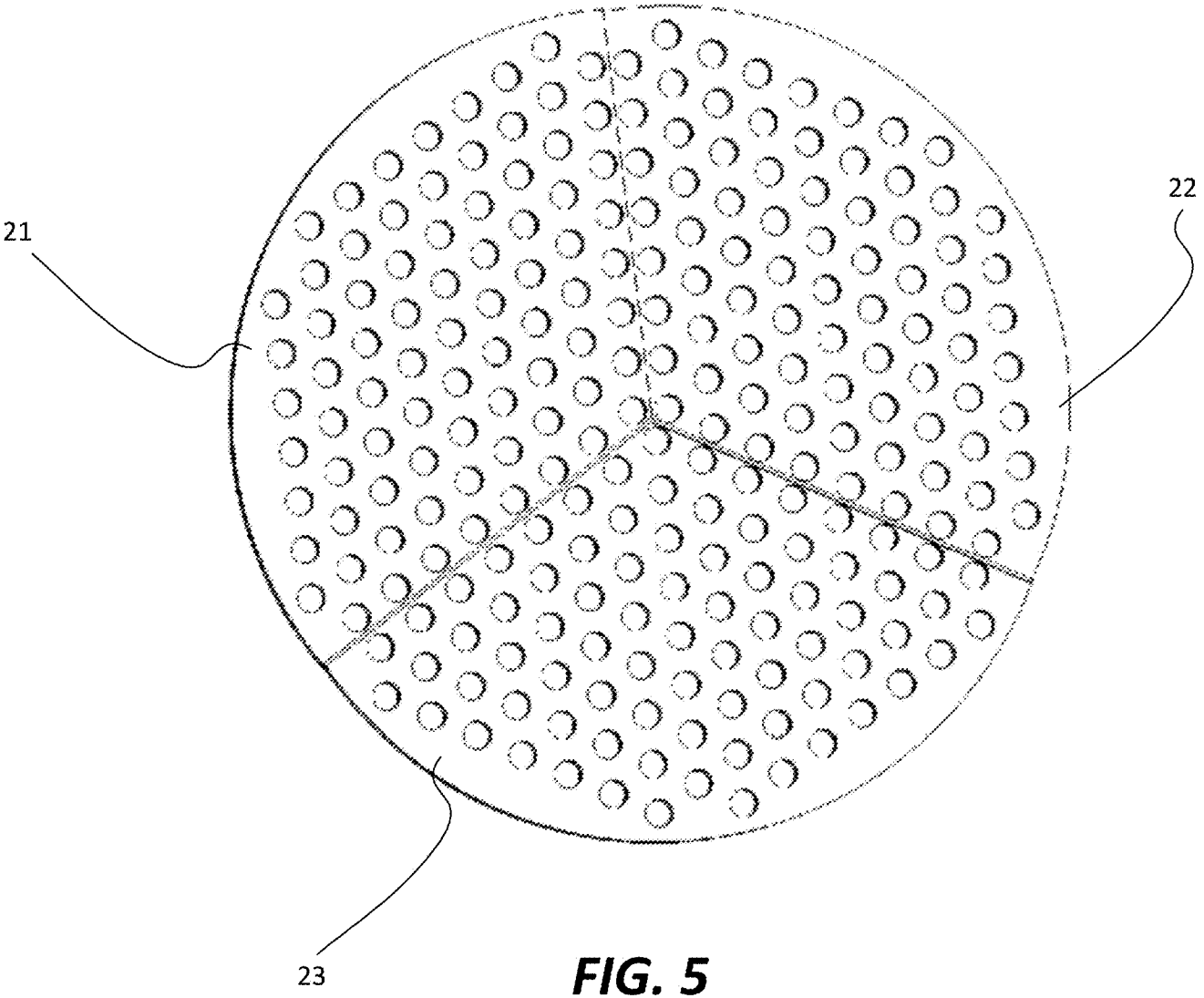
FIG. 5 is an end view of the stepped segmented baffle
Figure 6:
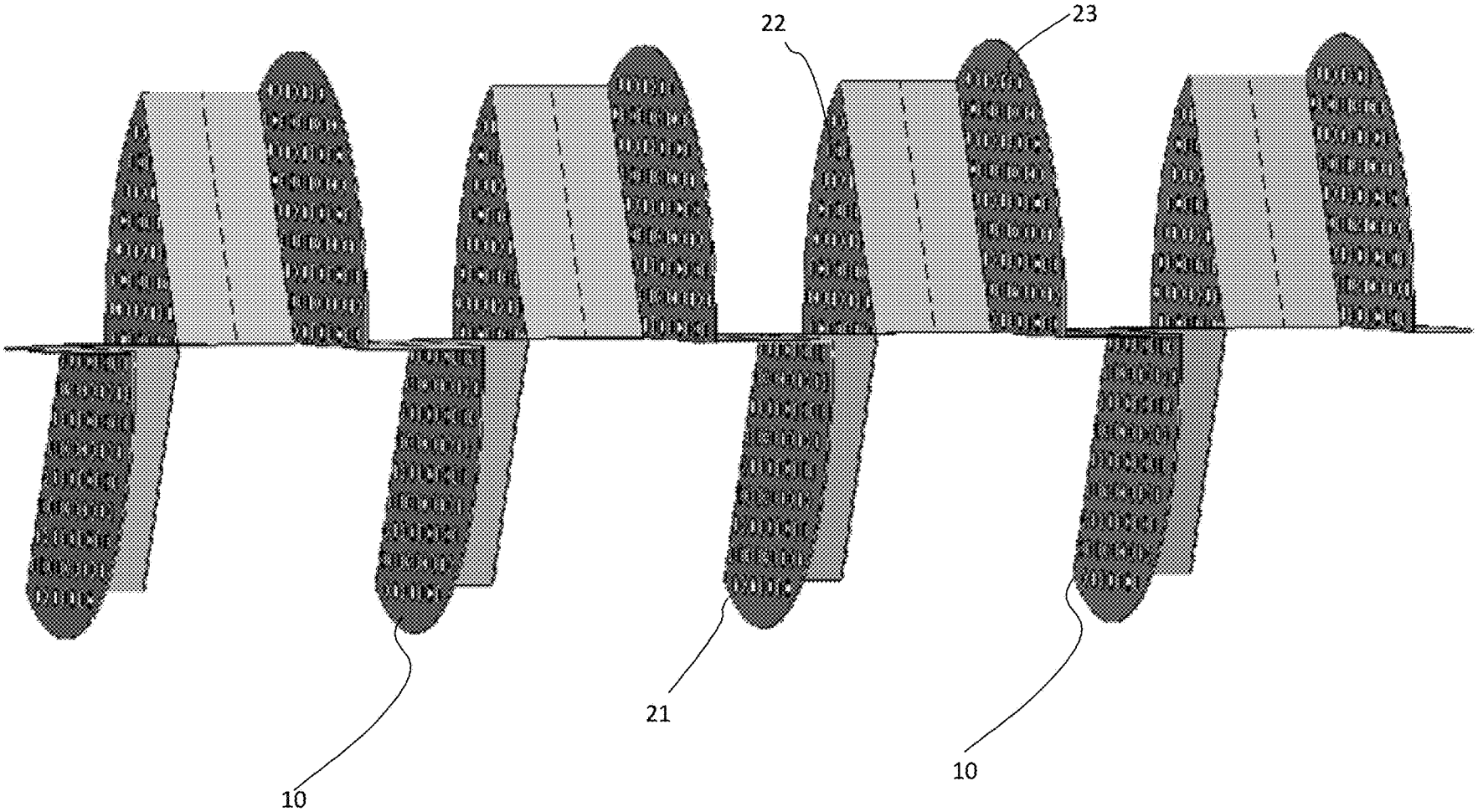
FIG. 6 is another perspective view of the stepped segmented baffle.
Figure 7:
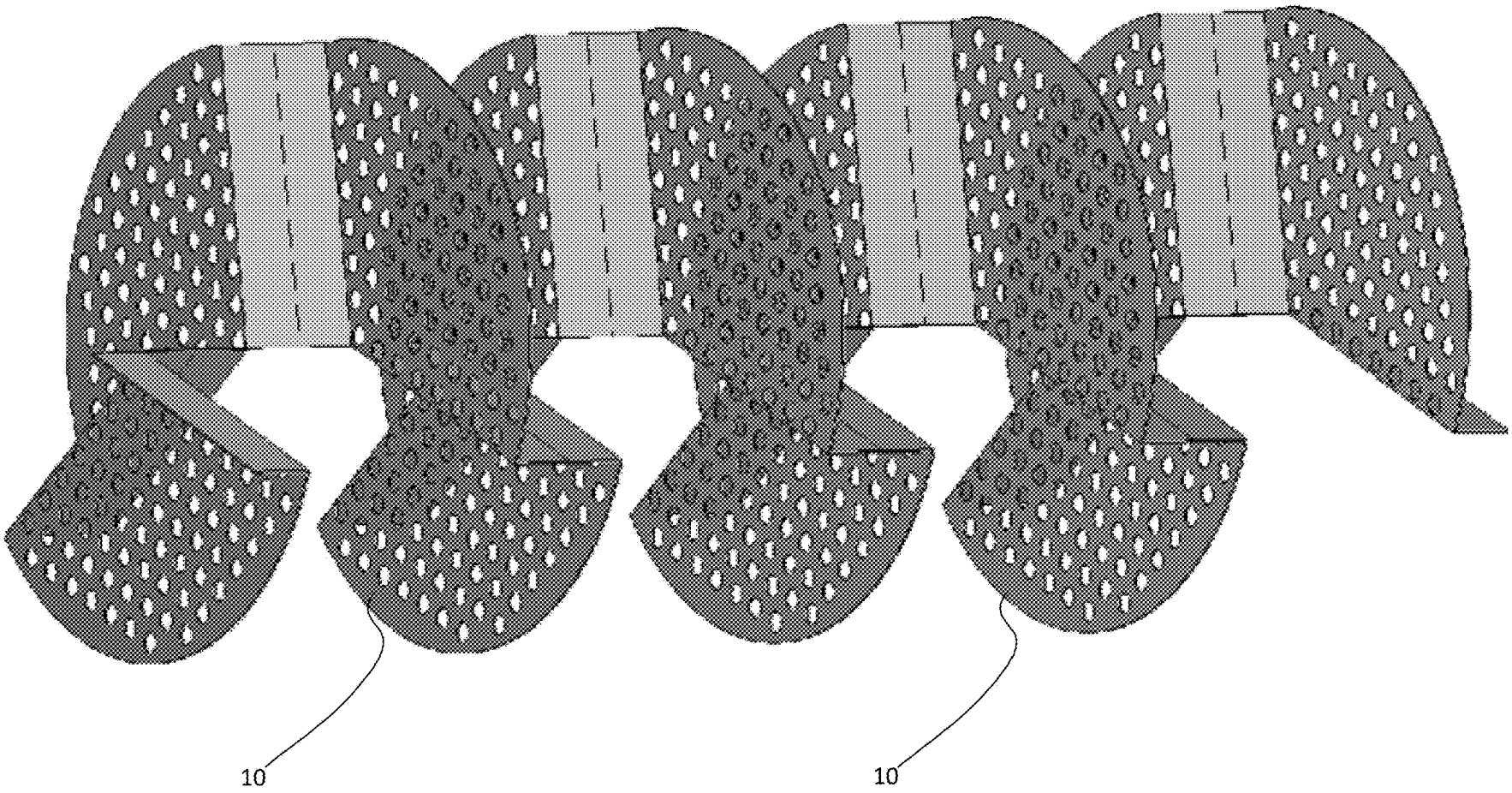
FIG. 7 is another perspective view of the stepped segmented baffle.
Figure 8:
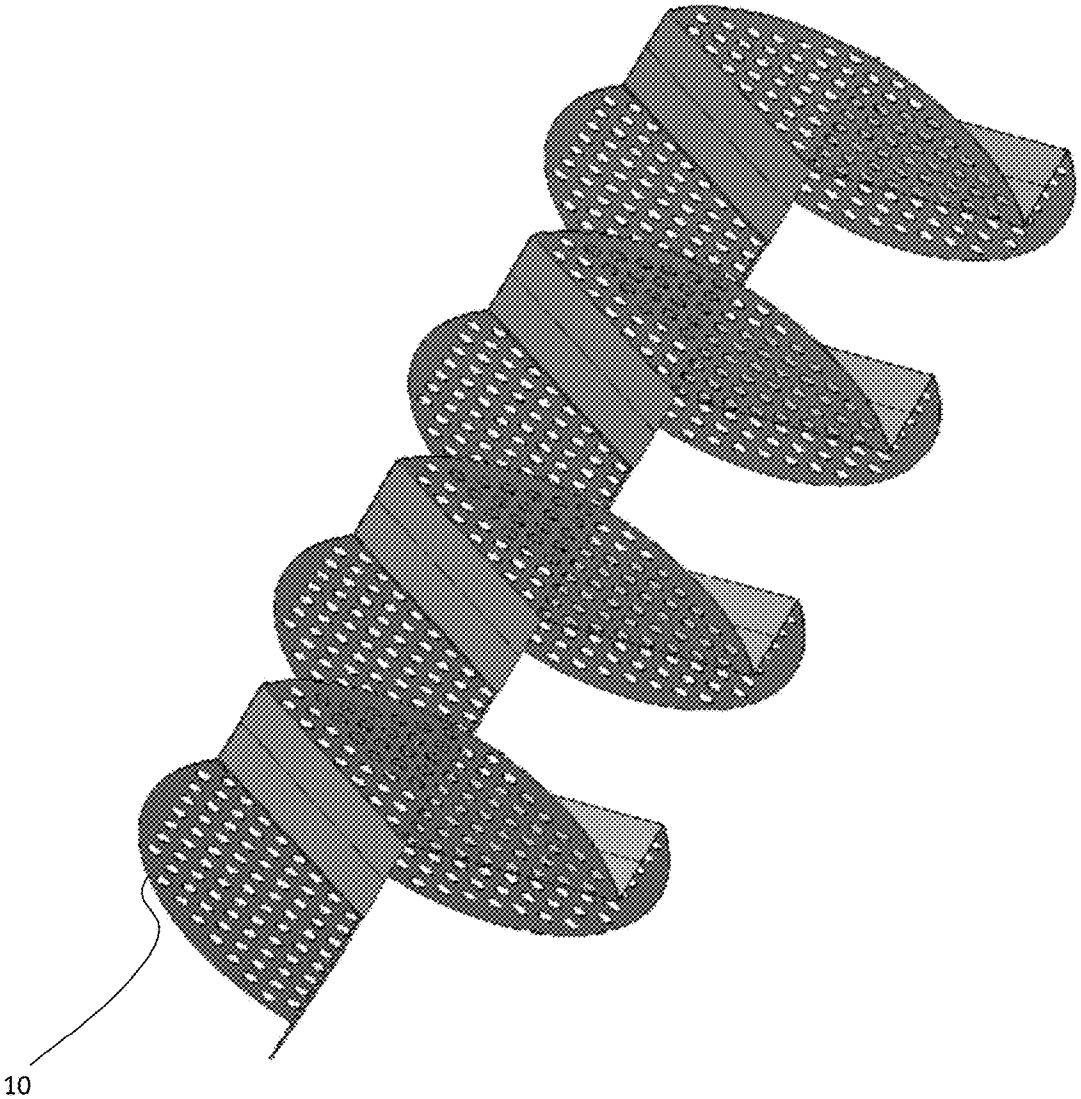
FIG. 8 is another perspective view of the stepped segmented baffle.
Figure 9:
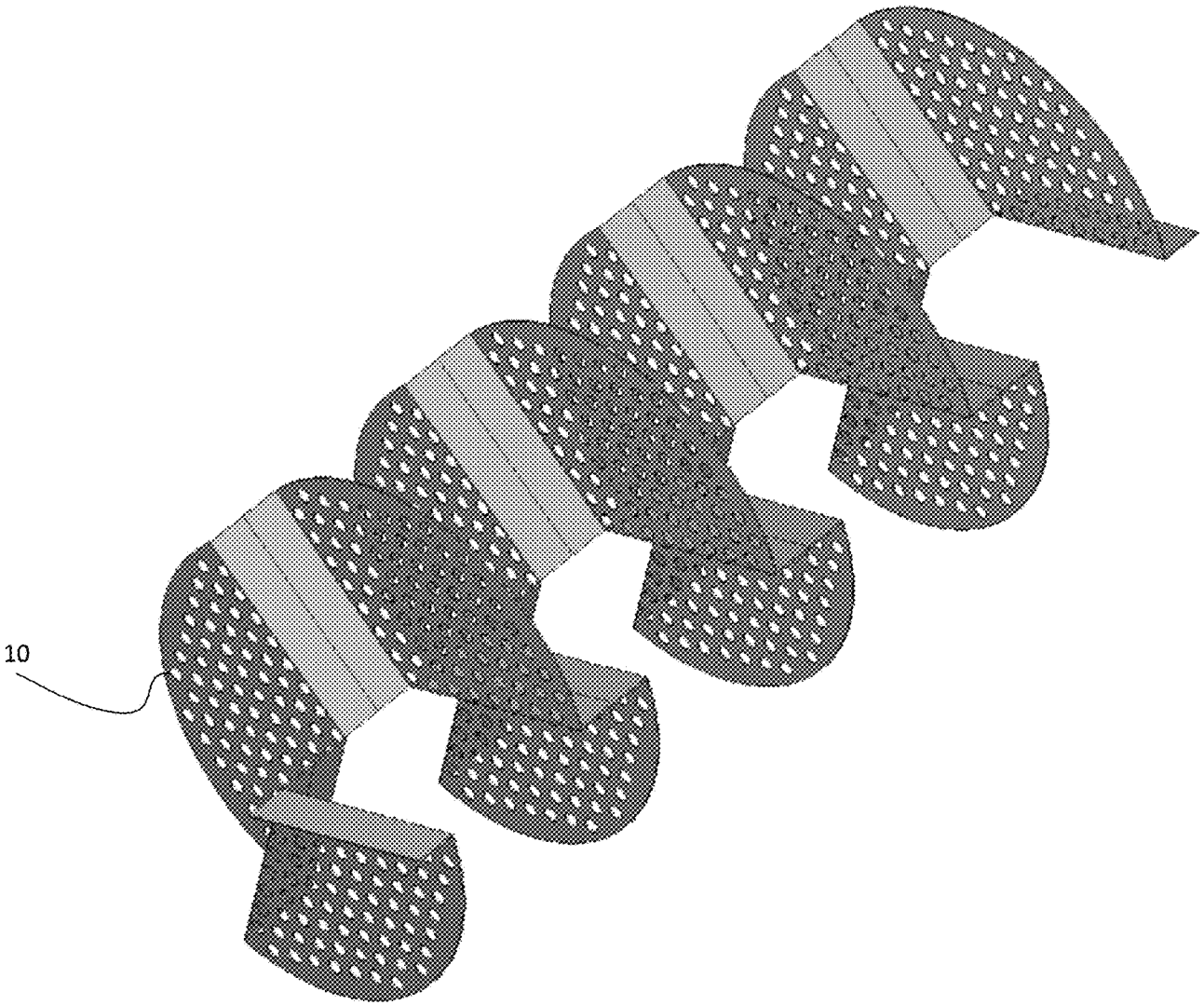
FIG. 9 is another perspective view of the stepped segmented baffle.
Figure 10:
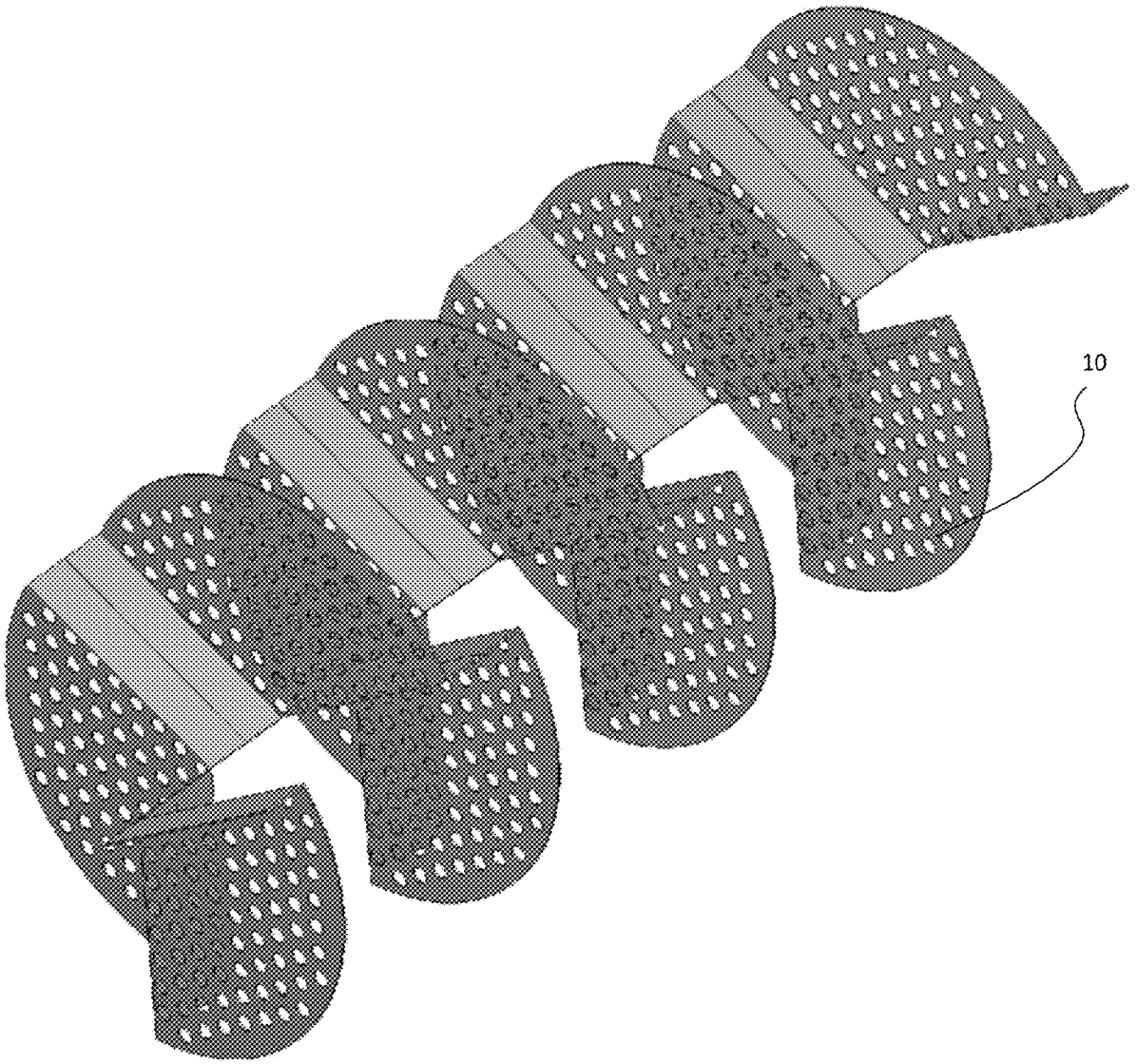
FIG. 10 is another perspective view of the stepped segmented baffle.
Figure 11:
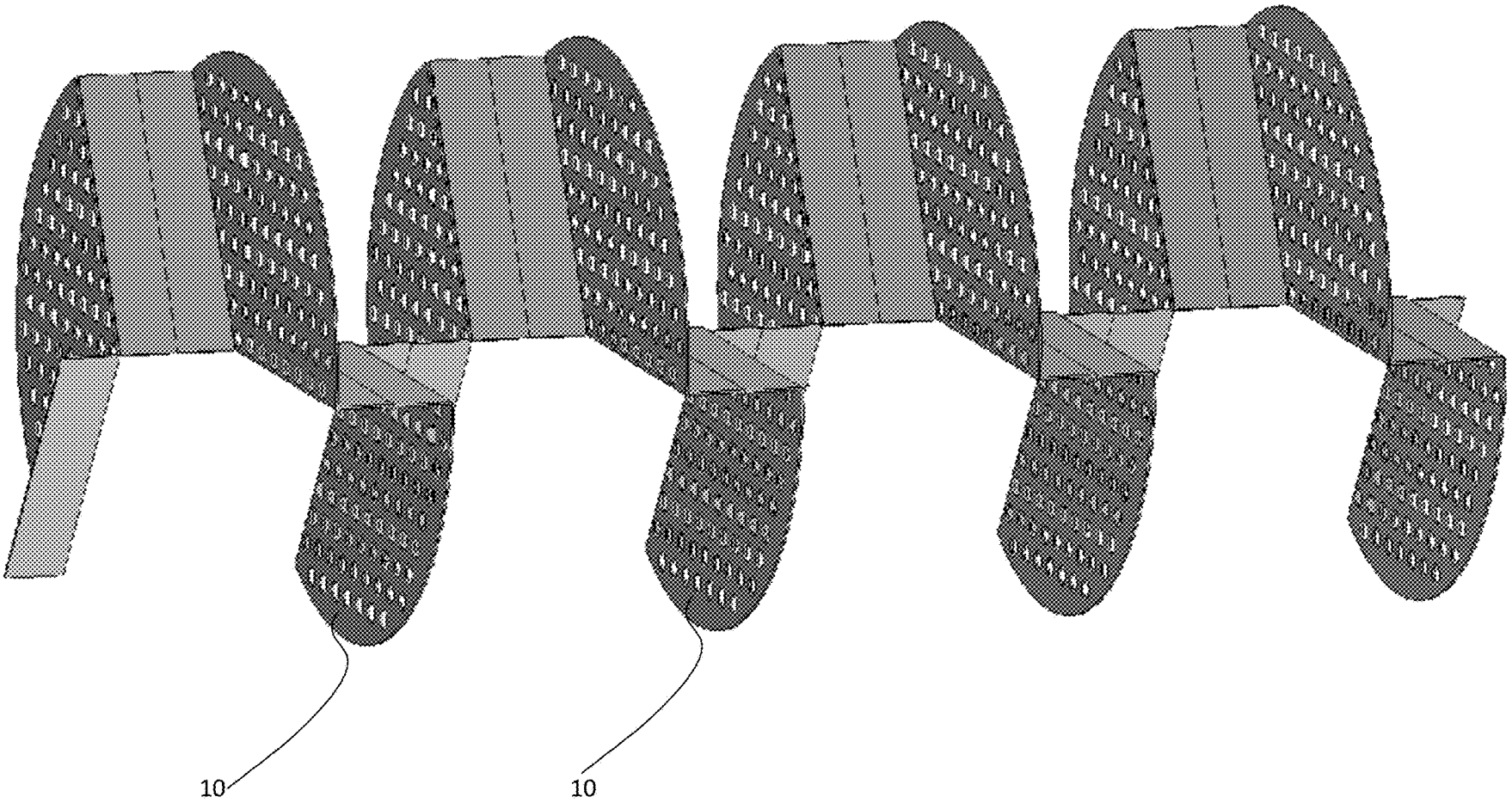
FIG. 11 is another perspective view of the stepped segmented baffle.
Figure 12:
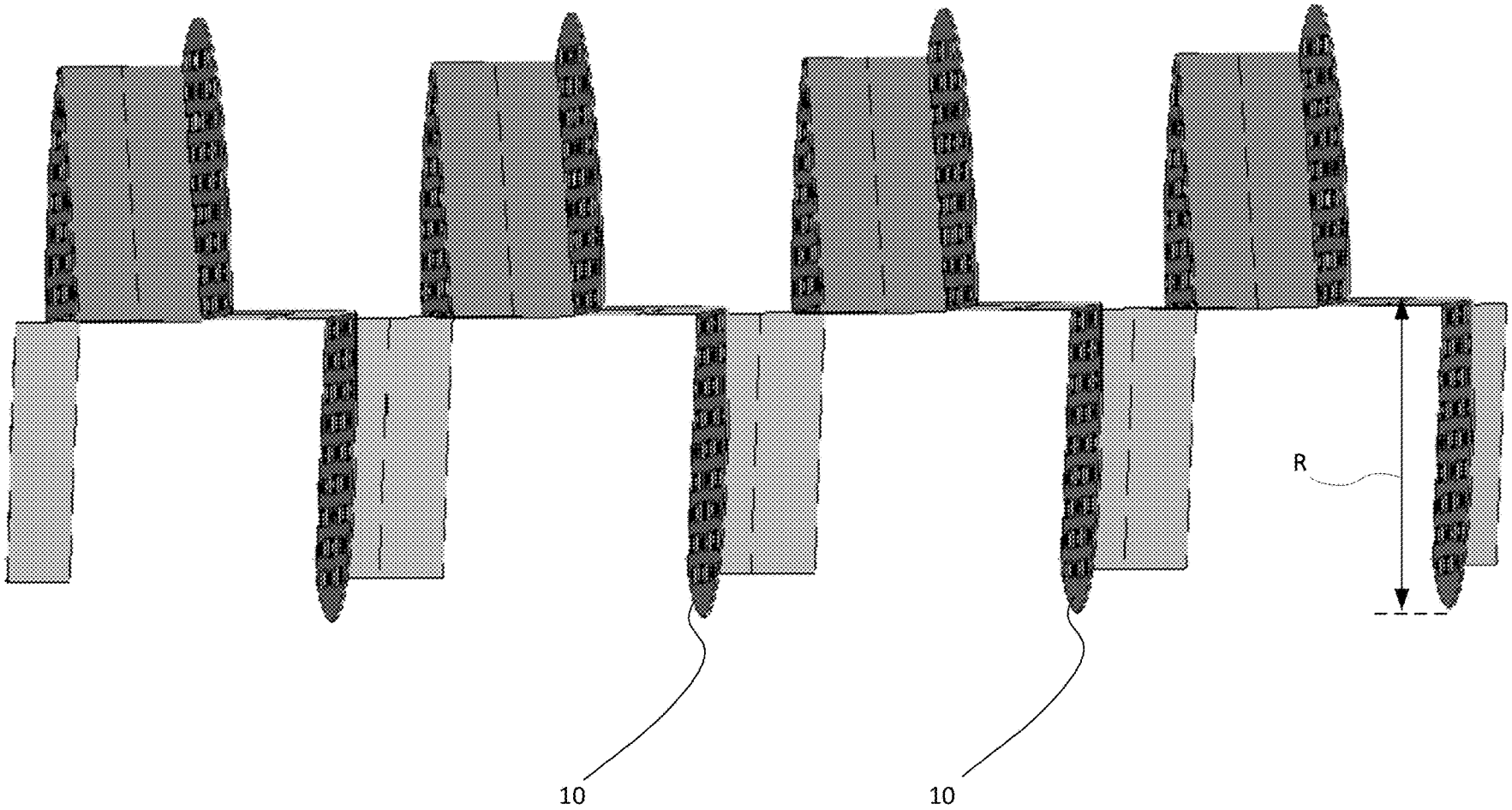
FIG. 12 is a side view of the stepped segmented baffle.
Figure 13:
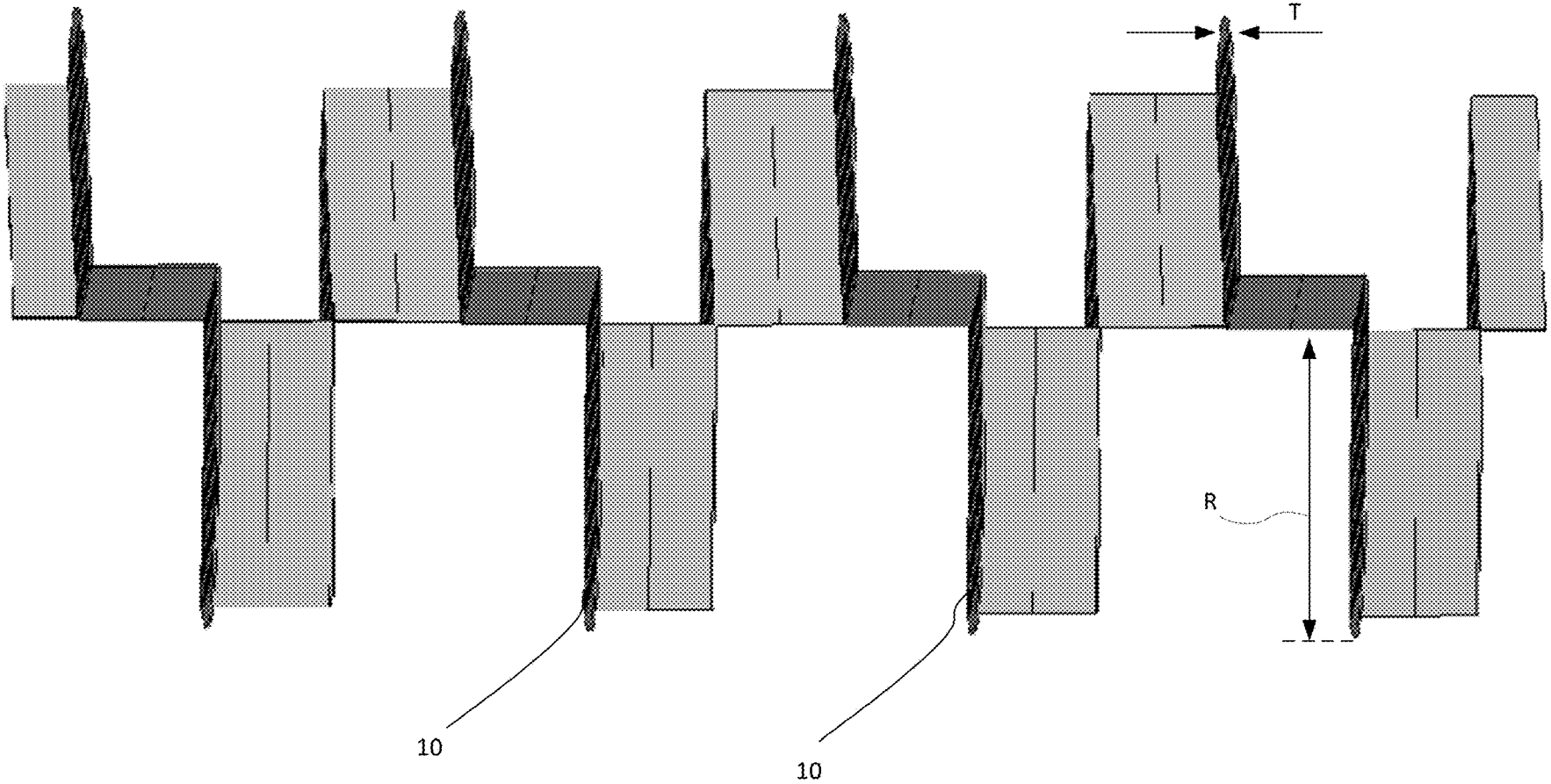
FIG. 13 is another perspective view of the stepped segmented baffle.
Figure 14:
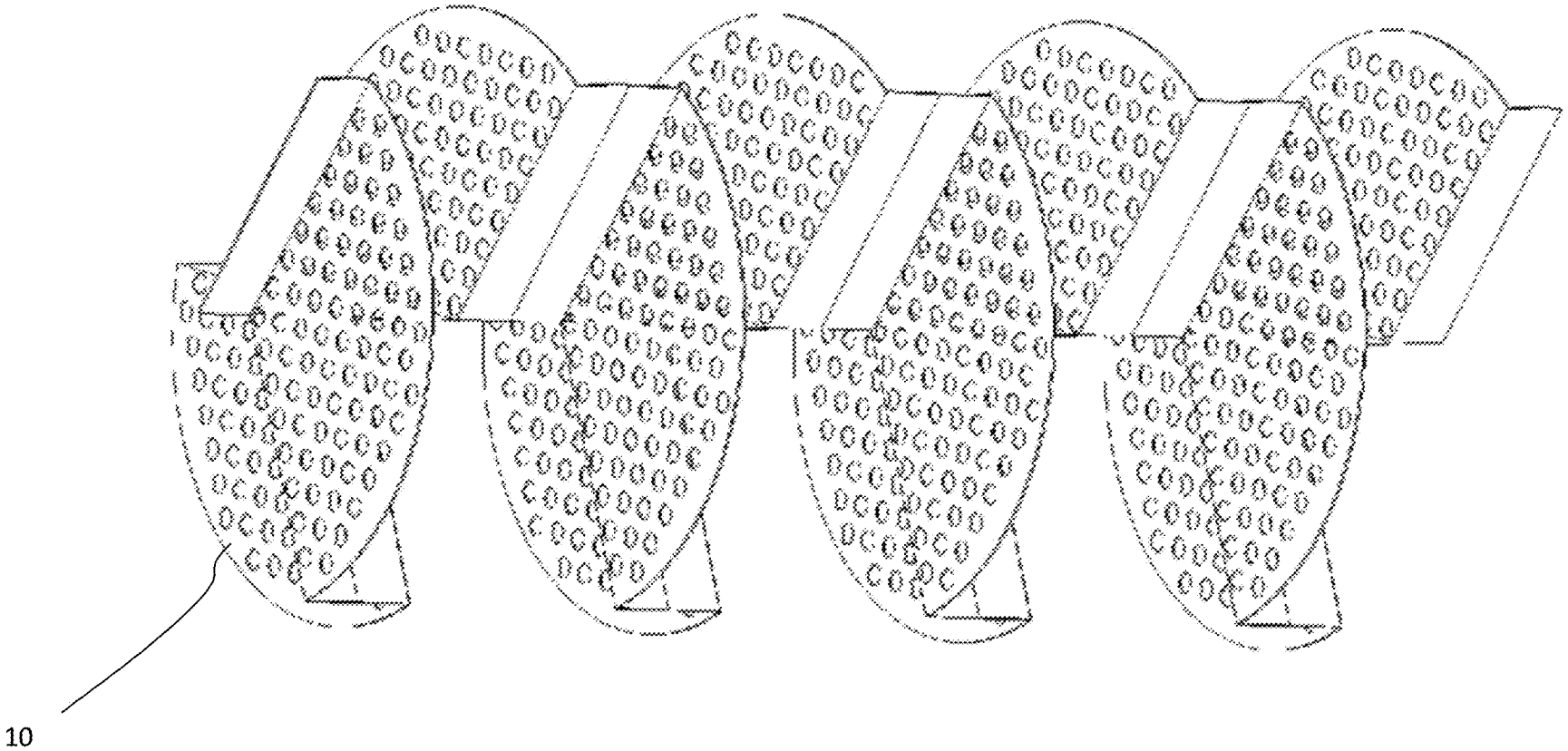
FIG. 14 is another perspective view of the stepped segmented baffle.
Figure 15:
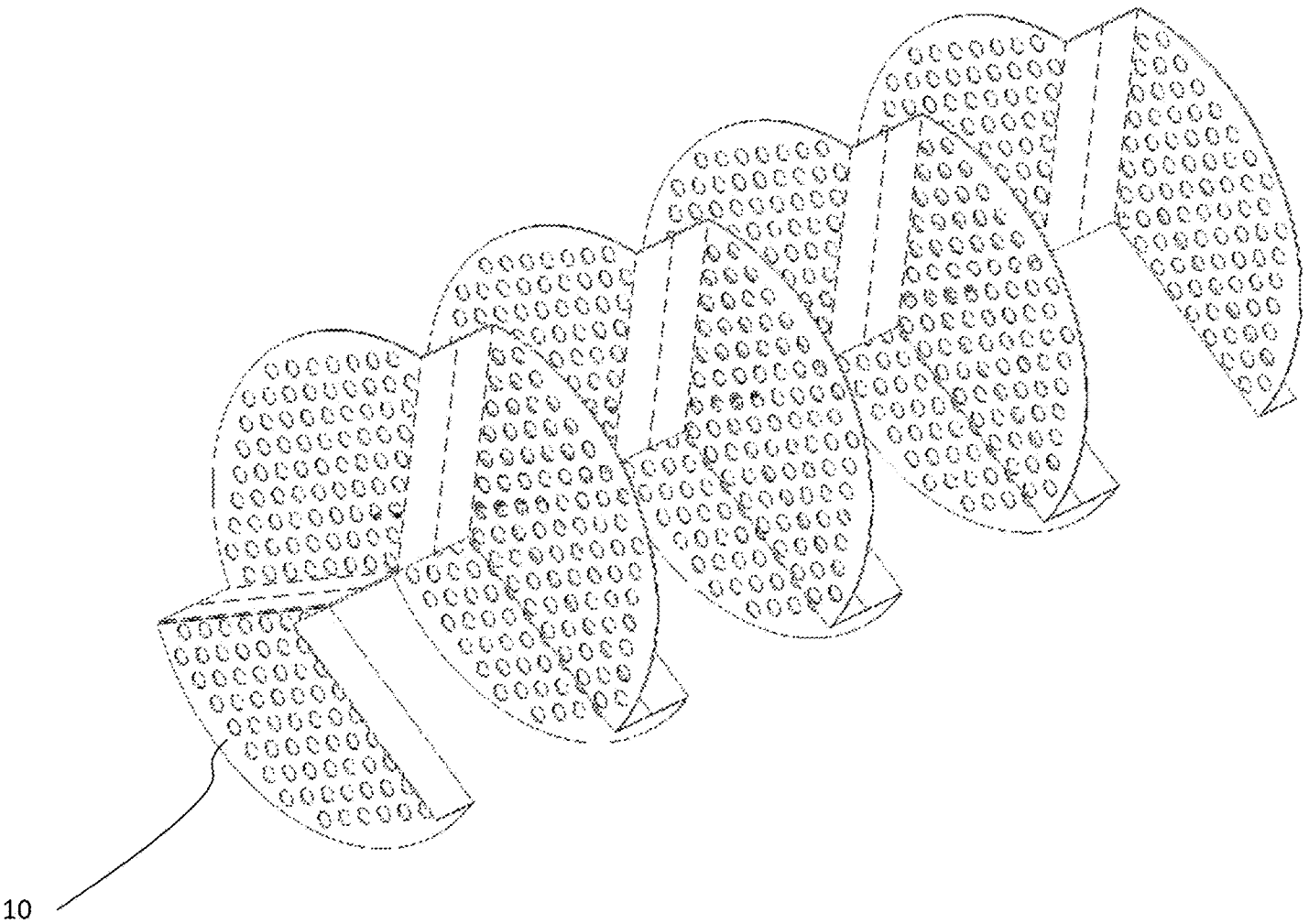
FIG. 15 is another perspective view of the stepped segmented baffle.

The following detailed description contains, for the purposes of explanation, numerous specific embodiments, implementations, examples and details in order to provide a thorough understanding of the invention. It is apparent, however, that the embodiments may be practiced without these specific details or with an equivalent arrangement. In other instances, some well-known structures and devices are shown in block diagram form in order to avoid unnecessarily obscuring the embodiments of the invention. The description should in no way be limited to the illustrative implementations, drawings, and techniques illustrated below, including the exemplary designs and implementations illustrated and described herein, but may be modified within the scope of the appended claims along with their full scope of equivalents.

FIGS. 1 to 15 are various views of a novel stepped segmented baffle in accordance with an embodiment of the present invention. The stepped segmented baffle is denoted by reference numeral 10. The stepped segmented baffle 10 is designed for use in an electric process heater. The electric process heater includes a heat exchanger in which the baffle acts to transfer heat from heating elements to a surrounding fluid as will be further described below.

Figure 16:
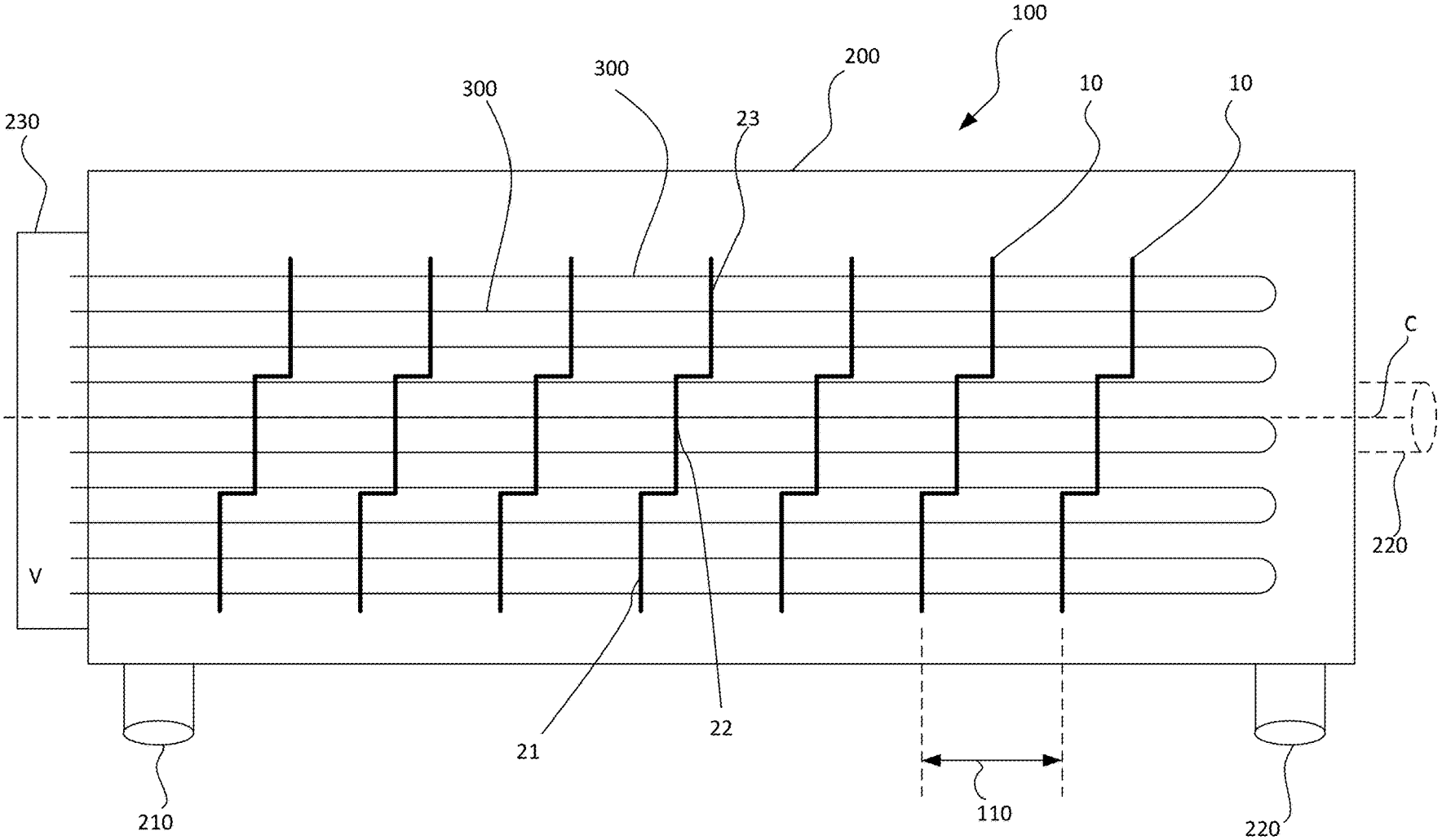
FIG. 16 is a schematic side view of an electric process heater having a plurality of stepped segmented baffles.

In the embodiment illustrated by way of example in FIGS. 1 to 15, the stepped segmental baffle 10 has a plurality of stepped segments 12 defined by a flat structure 14 that includes a plurality of perforations 16 through which elongated heating elements extend as depicted by way of example in the schematic illustration of an electric process heater in FIG. 16. In the embodiment illustrated in these figures, the stepped segments 12 are disposed orthogonally relative to a central axis C of the electric process heater. The stepped segments 12 are spaced apart from each other by an axial distance 18. As such, the stepped segments 12 are parallel to each other. The stepped segments 12 are supported by perpendicularly disposed segment support 15 which define surfaces that are orthogonal to the stepped segments 12 as shown in the figures.

In one specific embodiment, illustrated by way of example in FIGS. 1 to 15, the stepped segmented baffle 10 has a first stepped segment 21, a second stepped segment 22 and a third stepped segment 23. In another embodiment, the baffle 10 may have more than three stepped segments, e.g. four stepped segments, five stepped segments, six stepped segments, etc.

In one specific embodiment, illustrated by way of example in the figures, the first stepped segment 21, the second stepped segment 22 and the third stepped segment 23 have identical shapes.

In one specific embodiment, illustrated by way of example in the figures, the first stepped segment 21, the second stepped segment 22 and the third stepped segment 23 each define 120-degree sectors. When viewed from the end, therefore, the baffle covers 360 degrees. In another embodiment having four stepped segments, each sector would define 90-degree sectors. In another embodiment having five stepped segments, each sector would define 72-degree sectors. In another embodiment having six stepped segments, each sector would define 60-degree sectors. More than six sectors is also possible in other variants. In these embodiments, each sector is identical; however, in yet further embodiments, the sectors may be different (unequal) in size and/or angular span. In the embodiments described so far, the segments of a given baffle cover 360 degrees as noted above; however, in other embodiments, it may be possible to have segments that cover more than 360 degrees or less than 360 degrees.

In one specific embodiment, illustrated by way of example in FIGS. 1 to 15, the stepped segments 12 extend radially outward from the central axis C by a radial distance R greater than the axial distance. In the illustrated embodiment, the radial distance R of each segment is the same; however, in other embodiments, it may be possible to have segments of different radius, e.g. different radii R1, R2, R3.

In the embodiment illustrated by way of example in FIGS. 1 to 15, a thickness T of each one of the stepped segments is less than the axial distance. The segments 12 are thin to promote heat transfer between the fluid and the heating elements extending through the perforations (holes) 16.

In one specific embodiment, illustrated by way of example in the figures, the first stepped segment 21, the second stepped segment 22 and the third stepped segment 23 have the same number of perforations 16. Such an arrangement provides radial symmetry for the bundle(s) of heating elements inside the vessel. In another embodiment, however, it may be useful for some specific reason or application to provide a different number of perforations 16 on each segment. Similarly, as shown in the figures, the perforations 16 are all the same size (same diameter) in order to accommodate heating elements having a uniform diameter.

In one specific embodiment, illustrated by way of example in the figures, the axial distance between the first segment 21 and the second segment 22 is the same as the axial distance between the second segment 22 and the third segment 23. In another embodiment, the axial distance may be different. The stepped segmental baffle 10 can be made with varying axial distance (pitch) between the steps of the baffle to optimize the heater performance.

The stepped segmented baffle 10 may be manufactured, for example, by separately making each of the segments 12 and then joining the segments together to form the baffle. The stepped segmented baffle is thus easier and less expensive to manufacture than a spiral baffle or a helical baffle. The stepped baffle design with segments being orthogonal to the central axis provides excellent heat transfer characteristics.

In the embodiment depicted by way of example in FIG. 16, an electric process heater denoted generally by reference numeral 100 includes a fluid-containment vessel 200 containing a fluid and a plurality of elongated heating elements 300 extending inside the vessel parallel to a central axis C of the electric process heater that loop back in a hairpin arrangement as shown. The vessel 200 has a fluid inlet 210 and a fluid outlet 220. The fluid inlet 210 may be disposed on the side of the vessel as shown. Likewise, the fluid outlet 220 may be disposed on the side of the vessel. Alternatively, the fluid outlet 220 may be disposed on the end of the vessel as shown in dashed lines in FIG. 16. It is also possible to reverse the fluid inlet and fluid outlet so that the fluid flows in the opposite direction. The electric process heater 100 also has a wiring junction box denoted by reference numeral 230. In the embodiment of FIG. 16, all of the heating element connections are disposed at one end and extend through a piping flange attached to the vessel into the wiring junction box 230 to simplify electrical connections of the heating elements. The vessel 200 may alternatively be a closed tank without the fluid inlet and fluid outlet. The elongated heating elements 300 may be electrical heating elements, i.e. electrically resistive heating elements that generate heat when electric current flows through a resistor, wire, ribbon, or equivalent. Any suitable electrically resistive wire, ribbon or material may be used for the electric heating element such as, for example, nickel-chrome alloy or any functionally equivalent material capable of generating heat by resistance. In the illustrated embodiment, a voltage source V (or power source), which may be incorporated in the junction box 230, generates the electric current for the electrical heating elements. The electric process heater includes a plurality of stepped segmental baffles 10 disposed at axial intervals 110 inside the electric process heater to promote heat transfer between the elongated heating elements and the fluid inside the vessel.

The electric process heater 100 may be an immersion-type heater in which the heating elements are immersed in a fluid to be heated. The electric process heater may also be used or adapted for use in other types of heaters such as flange heaters, pressurized heaters, circulation heaters, etc. The electric process heater may be used in various heating applications for heating a fluid (liquid or gas) for various purposes such as, for example, temperature regulation, freeze protection, vaporization/boiling, stabilizing a condensate, reducing viscosity of a liquid, etc.

The novel baffles 10 may also be used in another type of heat exchanger such as a fluid-to-fluid heater or heat exchanger in which the heating elements are fluid-carrying tubes instead of electric heating elements. In other words, the baffles 10 may be used, or adapted for use, in other types of heat exchangers such as shell-and-tube heat exchanger in which a first fluid is carried through tubes inside a shell (vessel). The tubes extend through holes in baffles to exchange heat with a surrounding second fluid. It will be appreciated that this novel baffle design may find applications and uses in various other types of heat exchangers.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing", or verb tense variants thereof, are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g. "such as") is intended merely to better illustrate or describe embodiments of the invention and is not intended to limit the scope of the invention unless otherwise claimed.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the inventive concept(s) disclosed herein.

The invention claimed is:

1. A baffle for an electric process heater having a fluid-containment vessel defining a central axis and having a plurality of elongated heating elements extending inside the vessel, the baffle comprising:

a plurality of stepped segments, wherein each of the stepped segments is a flat structure having a plurality of perforations through which elongated heating elements extend and wherein the plurality of stepped segments comprises a first stepped segment, a second stepped segment and a third stepped segment, wherein the first stepped segment, the second stepped segment and the third stepped segment define sectors having different angular spans and wherein the baffles are spaced radially apart from the vessel;

wherein the stepped segments are disposed orthogonally relative to the central axis;

wherein the stepped segments are spaced apart from each other by a varying axial distance; and wherein the elongated heating elements define a hairpin configuration within the vessel.

2. The baffle of claim 1 wherein the first stepped segment, the second stepped segment and the third stepped segment have the same number of perforations.

3. An electric process heater comprising:

a vessel containing a fluid;

a plurality of elongated heating elements extending inside the vessel parallel to a central axis of the electric process heater;

a plurality of stepped segmental baffles disposed at axial intervals inside the electric process heater to promote heat transfer between the elongated heating elements and the fluid inside the vessel;

wherein each of the plurality of stepped segmental baffles has a plurality of stepped segments defined by a flat structure that includes a plurality of perforations through which the elongated heating elements extend, wherein the plurality of stepped segments of each baffle comprises a first stepped segment, a second stepped segment and a third stepped segment, wherein the first stepped segment, the second stepped segment and the third stepped segment define sectors having different angular spans and wherein the baffles are spaced radially apart from the vessel;

wherein the stepped segments are disposed orthogonally relative to the central axis;

wherein the stepped segments are spaced apart from each other by a varying axial distance; and wherein the elongated heating elements define a hairpin configuration within the vessel.

4. The electric process heater of claim 3 wherein the first stepped segment, the second stepped segment and the third stepped segment have the same number of perforations.

5. The electric process heater of claim 3 wherein the first stepped segment has a first perpendicularly disposed segment support defining a first edge and wherein the second stepped segment has a second perpendicularly disposed segment support defining a second edge that is connected to the first edge.

6. The electric process heater of claim 3 comprising a piping flange attached to the vessel and a wiring junction box, wherein heating element connections of the heating elements extend through the piping flange into the wiring junction box.

* * * * *